US007686570B2

(12) United States Patent
Allen

(10) Patent No.: US 7,686,570 B2
(45) Date of Patent: Mar. 30, 2010

(54) ABRADABLE COATING SYSTEM

(75) Inventor: David B. Allen, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 621 days.

(21) Appl. No.: 11/497,112

(22) Filed: Aug. 1, 2006

(65) Prior Publication Data

US 2009/0148278 A1 Jun. 11, 2009

(51) Int. Cl.
*F01D 11/12* (2006.01)

(52) U.S. Cl. ..... 415/9; 415/173.4; 415/174.4; 428/117

(58) Field of Classification Search ..... 415/173.4, 415/174.4, 9; 428/117, 212
See application file for complete search history.

(56) References Cited

U.S. PATENT DOCUMENTS 2,742,224 A * 4/1956 Burhans ..... 415/9
4,806,136 A 2/1989 Kiersz et al.
4,867,639 A * 9/1989 Strangman ..... 415/173.4
5,224,336 A 7/1993 Agrawal et al.
5,722,259 A 3/1998 Sorensen et al.
5,979,183 A 11/1999 Smith et al.
6,106,959 A * 8/2000 Vance et al. ..... 428/623
6,173,563 B1 1/2001 Vakil et al.
6,190,124 B1 * 2/2001 Freling et al. ..... 415/173.4
6,203,021 B1 * 3/2001 Wolfla et al. ..... 277/415
6,220,013 B1 4/2001 Smith
6,235,370 B1 * 5/2001 Merrill et al. ..... 428/116
6,397,575 B2 6/2002 Tomlinson et al.
6,838,157 B2 * 1/2005 Subramanian ..... 428/173
6,846,574 B2 * 1/2005 Subramanian ..... 428/595
6,871,502 B2 3/2005 Marin et al.
6,877,322 B2 4/2005 Fan
6,881,029 B2 * 4/2005 Le Biez et al. ..... 415/173.4
2003/0041518 A1 3/2003 Wallace et al.
2003/0083391 A1 5/2003 Jahnke et al.
2003/0119919 A1 6/2003 Allam et al.
2003/0181314 A1 9/2003 Kranz
2003/0182944 A1 10/2003 Hoffman et al.
2004/0031256 A1 2/2004 Rollins, III

* cited by examiner

*Primary Examiner*—Edward Look
*Assistant Examiner*—Ryan H Ellis

(57) ABSTRACT

This invention relates to an abradable coating system for use in axial turbine engines. When coated onto a turbine ring seal segment the coating system may allow formation of an individualized seal between turbine blade disks and the surrounding ring seal without causing excessive wear to the blade tips. The abradable coating system includes columns of an abradable material. Thus, interference between the blades and the abradable coating system causes the individual columns to break off at the base. This abrasion mechanism may reduce blade wear and spalling of the coating system when compared to conventional coatings.

19 Claims, 8 Drawing Sheets

ABRADABLE COATING SYSTEM

FIELD OF THE INVENTION

This invention is directed generally to abradable coating systems, and more particularly to abradable coating systems useful for creating individualized seals between turbine blades and corresponding ring segment shrouds.

BACKGROUND

Axial gas turbines typically contain rows of turbine blades, referred to as stages, coupled to disks that rotate on a rotor assembly. The turbine blades extend radially and terminate in turbine blade tips. Ring seal segments are positioned radially outward from the turbine blade tips, but in close proximity to the tips of the turbine blades to limit gases from passing through the gap created between the turbine blade tips and the inner surfaces of the ring seal segments. The gaps between the turbine blade tips and the ring seal segments are designed to be as small as possible between the blade tips and the surrounding segment because the larger that gap, the more inefficient the turbine engine.

The size of the gap between the tips of the turbine blades and the ring seal segments must account for the turbine blades and the ring seal segments being formed from materials having different coefficients of thermal expansion. As a turbine engine begins to heat up during startup procedures, the length of the turbine blades increases radially outward while the ring seal segments move radially outward as well. The gap may change during the thermal growth. Thus, the gap is sized such that at steady state operating conditions in which the turbine blades are heated to an operating temperature, the gap is a small as possible without risking significant damage from the tips contacting the ring seal segments. However, as the gap is reduced, the incidences of rubbing between the turbine blade tips and the outer ring seal increases.

Attempts have been made to minimize the clearance gap to improve efficiency while avoiding excessive wear on the turbine blade tips. For instance, some conventional turbine engines include thermal barrier coatings (TBCs) on the ring seal segments that are designed to abrade when contacted by the blade tips. The TBCs also insulate the underlying turbine components from the hot gases present during operation, which may be approximately 2500 degrees Fahrenheit. Use of the TBCs can keep the underlying turbine component generally at temperature of less than approximately 1800 degrees Fahrenheit.

While the gap between the tips of the turbine blade and the ring seal segments may be designed to enable smooth startup from a cold engine, problems are typically encountered during a warm restart. In particular, a warm restart occurs when a turbine engine running at steady state operating temperatures is shut down, allowed to cool for two to three hours, and then restarted. During the restart, the turbine blade tips often contact the abradable coating on the ring seal segments because during the shut down period turbine disks remain hot and thermally expanded radially, while the thermally insulated turbine shroud ring has cooled and retracted somewhat, thereby reducing the gap. With the gap reduced, the turbine blade tips often contact the abradable coating.

Abradable coatings are designed such that when contacted by a turbine blade, a portion of the coating will break away to prevent damage to the turbine blade. A problem that is widespread with abradable coatings is that the coatings generally sinter after exposure to turbine engine operating temperatures of about 2,500 degrees Fahrenheit after about 50 to 100 hours.

Sintering of the abradable coating significantly reduces the abradable coatings ability to shear when contacted by tips of turbine blades. For instance, as shown in FIG. 1, abradable coatings greatly lose their ability to shear when contacted by tips of turbine blades with greater and greater exposure to turbine engine operating temperatures. In particular, FIG. 1 illustrates the impact of sintering on the abradability of a conventional abradable coating, 79% dense 8YSZ, 8YSZ refers to 8 weight percent yttria stabilized zirconia, which is a common TBC in both aero and IGT engines. The coating exhibited an abradability volume wear ratio (VWR) of 34 (coating wear/blade wear, where larger values are better) prior to exposure to elevated temperatures. After the same coating was exposed to approximately 2000 degrees Fahrenheit for 200 hours, the VWR declined to nine. The VWR declined to seven when exposed to approximately 2200 degrees Fahrenheit for 200 hours. Finally, the VWR was two after exposure to approximately 2375 degrees Fahrenheit for 200 hours. Thus, the usefulness of an abradable coating is nearly negated once sintered. Therefore, a need exists for an abradable coating system capable of shearing when contacted by turbine blade tips even if a portion of the abradable coating has sintered.

SUMMARY OF THE INVENTION

This invention relates to an abradable coating system for use in axial turbine engines. In particular, the abradable coating system may include an abradable coating formed from a plurality of columns that limit sintering of the coating to outermost portions of the coating, thereby enabling the columns forming the abradable coating to shear off near the base of the columns. Shearing in the unsintered area near the base of the column creates for a smooth break with reduced losses relative to the prior art.

The abradable coating system may include an abradable coating attachable to an outer surface of a turbine component, such as but not limited to, a ring seal segment, also known as a blade outer air seal (BOAS). The abradable coating may be formed from any ceramic powder capable of being thermally sprayed, such as, but not limited to, 8YSZ, compositions of ceria-stabilized zirconia, materials that are capable of withstanding higher temperatures and are not based on yttria, ceria or zirconia, and other appropriate materials. The abradable coating system may also include a forming matrix supported on the outer surface of the turbine component. The forming matrix may be formed from a plurality of walls that are coupled together to form a plurality of cells having at least one opening opposite the outer surface for receiving the abradable coating. The forming matrix may be formed from a material having a melting point less than about 2,500 degrees Fahrenheit such that the forming matrix melts during operation of a turbine engine in which the coating system is positioned, thereby leaving the first abradable coating attached to the turbine component and forming a plurality of columns from the abradable coating. The forming matrix may be a fugitive material such as, but not limited to plastics, molybdenum, and other appropriate materials. The choice of fugitive materials is based more upon convenience than on composition, since any material that can be formed into the desired "forming matrix" shape (herein termed "honeycomb") that will burn off at turbine temperatures will be a suitable choice. Polymer materials such as common plastics may be used and, unless very high temperature thermal spraying is required, have been shown to function well. For higher temperature spray requirements, metal "honeycomb" or metalized plastics may be used. Molybdenum and moly alloys are suitable choices since they tend to form volatile oxides rather than melting when heated in oxidizing atmospheres. Fugitive materials are materials that occupy a physical area and burn off when exposed to temperatures above a threshold temperature, leaving a void absent of the fugitive materials where the materials once existed.

The forming matrix may have a wall thickness of less than about five mils (0.005 inches), with typical thicknesses being approximately one mil. The cells of the forming matrix may have a cross-sectional area in a plane generally aligned with the outer surface of the turbine component that is less than about two $mm^2$ and typically will be less than one $mm^2$. At least one cell of the plurality of cells forming the forming matrix may have a cross-sectional shape that is selected from the group consisting of a circle, an ellipse, a triangle, a rectangle, a hexagon, and a diamond.

The abradable coating system may also include a second coating deposited between the first abradable coating and the outer surface of a turbine component and below the first abradable coating such that said forming matrix is attached to an outer surface of the second coating. The second coating may be a thermal barrier coating or a bond coating, or other appropriate material. In one embodiment, a bond coating may be deposited on the outer surface of the turbine component, and the second coating may be a thermal coating deposited on the bond coating.

The abradable coating system may include an alarm system for identifying whether a turbine blade tip has contacted the first abradable coating. The alarm system may be formed from a metalized layer positioned between an outer surface of the turbine component and a tip of the columns of the abradable coating, wherein the metalized layer may be coupled to the alarm system that is usable for actuating an alarm when a tip of a turbine blade contacts the metalized layer indicating the tip has worn through a predetermined distance of the abradable coating. The abradable coating system may also include a temperature sensor on the first abradable coating. The temperature sensor may be formed from at least two metals.

During use, a turbine engine is ramped up to a steady state operating temperature. At the steady state operating condition, the abradable coating system is typically exposed to gases having temperatures of about 2,500 degrees Fahrenheit. Exposure of the forming matrix to these gases causes the forming matrix to burn, thereby leaving the inter-columnar channels and forming columns of the abradable coating. The width of the inter-columnar channels 46 may be between about 0.25 mm and about 1.5 mm. After prolonged exposure to the exhaust gases, the tips of the columns of the abradable coating may become sintered; however, the bases of the columns are either unsintered or sintered to a much lesser degree than the tips. Thus, should a tip of a turbine blade contact the abradable coating, such as during a warm restart, the columns of the abradable coating may shear at the base, thereby breaking free and protecting the tip of the turbine blade from damage. The columns may also provide the abradable coating with an increased resistance to spallation due to the inter-columnar channels that enable the columns to expand.

An advantage of this invention is that the columnar structure of the abradable coating system allows columns to break near the base, resulting in reduced blade wear compared to the conventional systems. This configuration is particularly advantageous after the tips of the columns of the abradable coating become sintered, in part, because the base of the columns may not be sintered.

Another advantage of the invention is that the abradable coating reduces or eliminates thermal barrier coating (TBC) spallation due to thermal cycling since the columnar structure naturally relieves thermally-induced strains caused by the contraction and expansion of the underlying metal substrate.

Yet another advantage of the invention is that the abradable coating may include an alarm system and thermocouples for monitoring the performance and condition of the abradable coating system and the turbine engine.

These and other embodiments are described in more detail below.

BRIEF DESCRIPTION OF THE DRAWINGS

The accompanying drawings, which are incorporated herein and form a part of the specification, illustrate embodiments of the presently disclosed invention and, together with the description, disclose the principles of the invention.

DETAILED DESCRIPTION OF THE INVENTION

Figure 1:
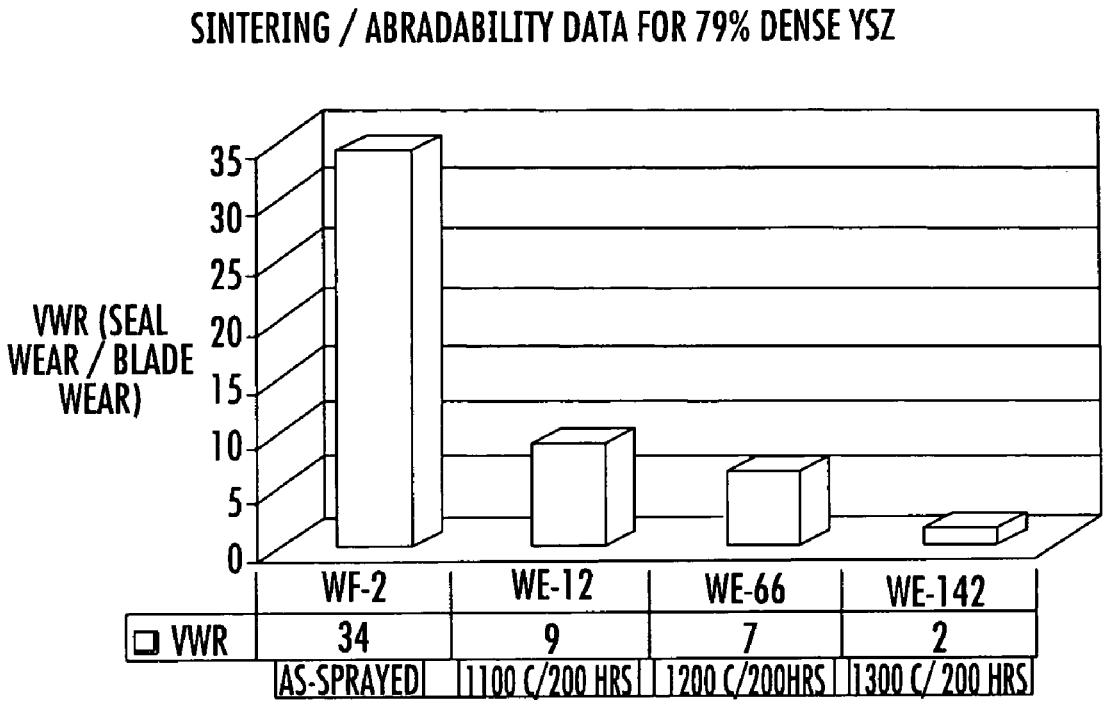
FIG. 1 (PRIOR ART)
FIG. 1 is a chart showing the impact of high temperatures on the abradability of a conventional abradable coating.

As shown in FIGS. 2-14, this invention is directed to an abradable coating system 10 for use in turbine engines 12. In particular, the abradable coating system 10 may include an abradable coating 14 formed from a plurality of columns 16 that limit sintering of the coating 14 to outermost portions of the coating 14, thereby enabling the columns 16 forming the abradable coating 14 to shear off near the base 18 of the columns 16. The abradable coating 14 may be applied to an outer surface 17 of a turbine component 19, such as, but not limited to, one or more turbine ring seal segments 20. The turbine ring seal segments 20 may be positioned radially outward from tips 22 of turbine blades 24 to create a seal between the turbine blades 24 and the surrounding ring seal segments 20. The abradable coating system 10 may be formed an abradable material and may have a columnar configuration that prevents bases 18 of the columns 16 from sintering, thereby enabling the columns 16 to break at the base 18 if struck by a turbine blade 24. The abradable columnar coating material be composed of a substance that is abradable and thermally resistant, such as, but not limited to 8YSZ, ceria stabilized zirconia, and other coatings not based on yttria, ceria, or zirconia. The abradable coating system 10 may reduce blade wear and spalling of the abradable coating 14 in comparison with conventional coatings.

Figure 2:
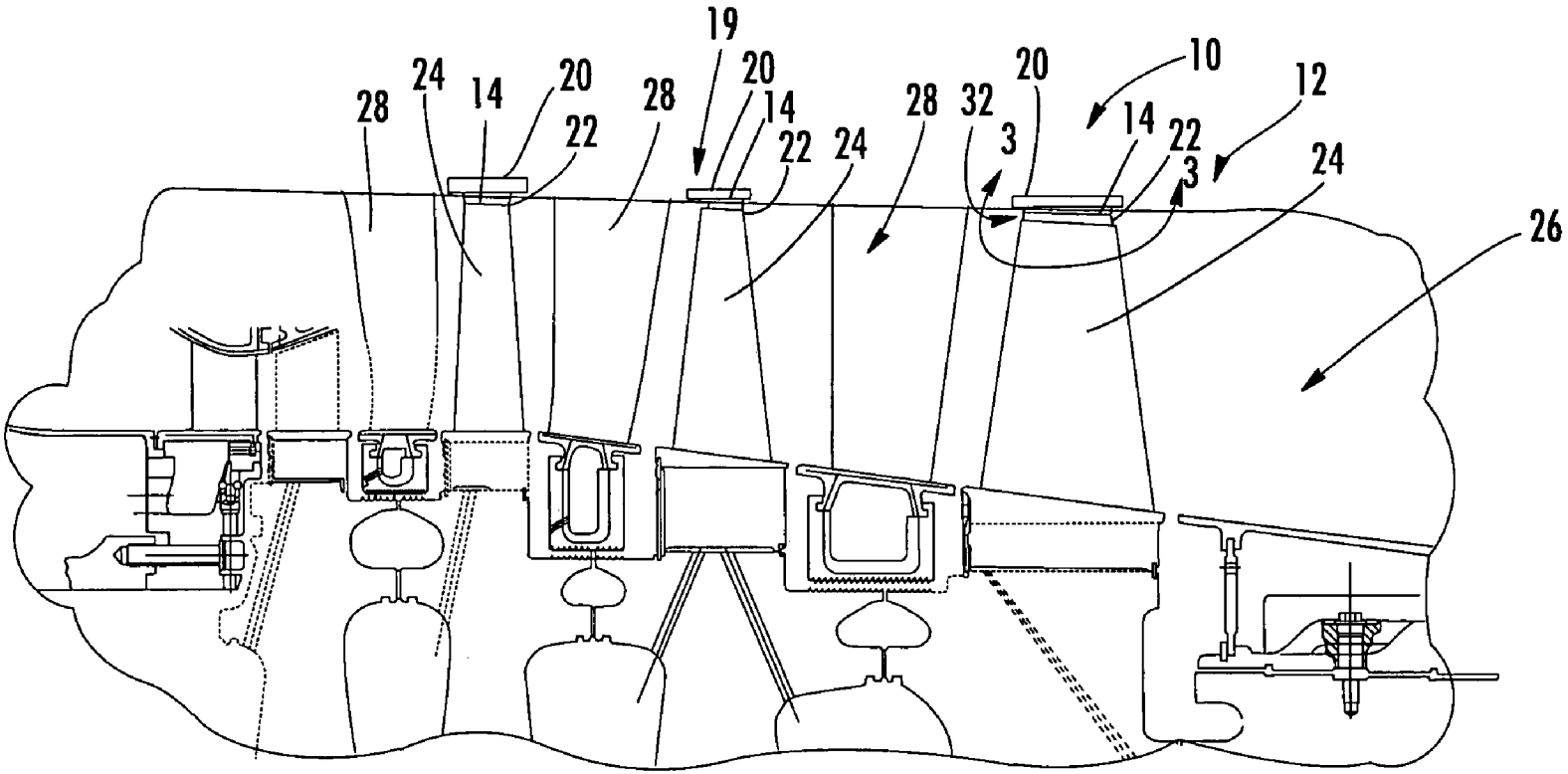
FIG. 2 is a cross-sectional view of turbine engine with a rotor assembly and including aspects of this invention.
Figure 3:
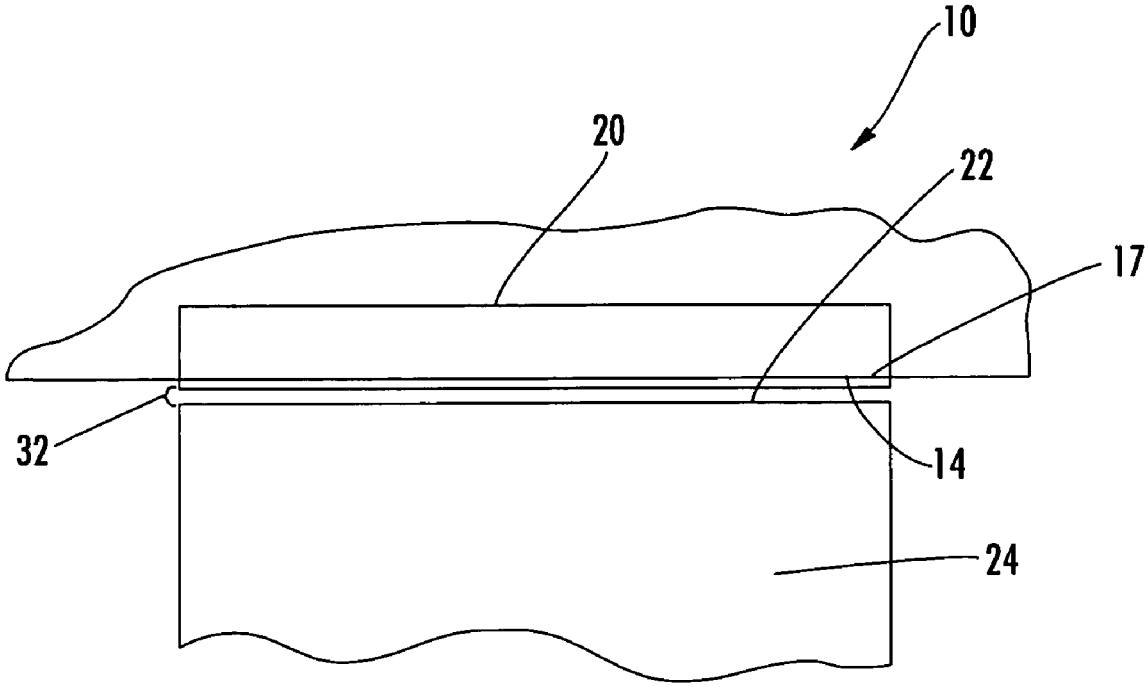
FIG. 3 is a detailed view taken at detail 3-3 in FIG. 2 of the abradable coating system.
Figure 4:
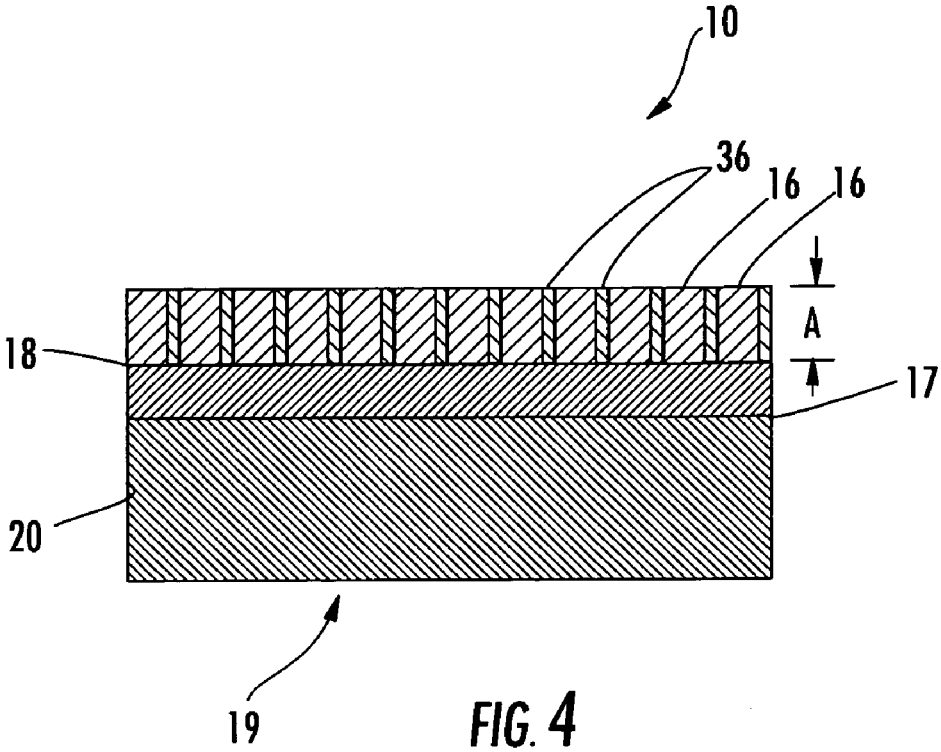
FIG. 4 is a cross-sectional view of the abradable coating system of this invention with the forming matrix intact.
Figure 5:
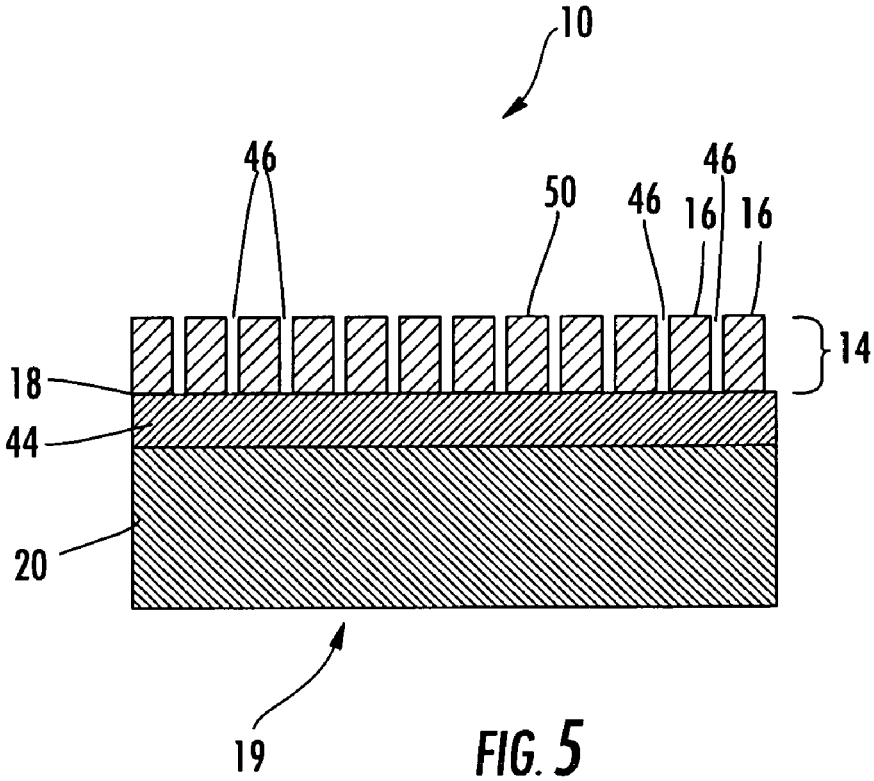
FIG. 5 is a cross-sectional view of the abradable coating system of this invention after the forming matrix has been burned off due to exposure to turbine engine steady state operating temperatures.
Figure 6:
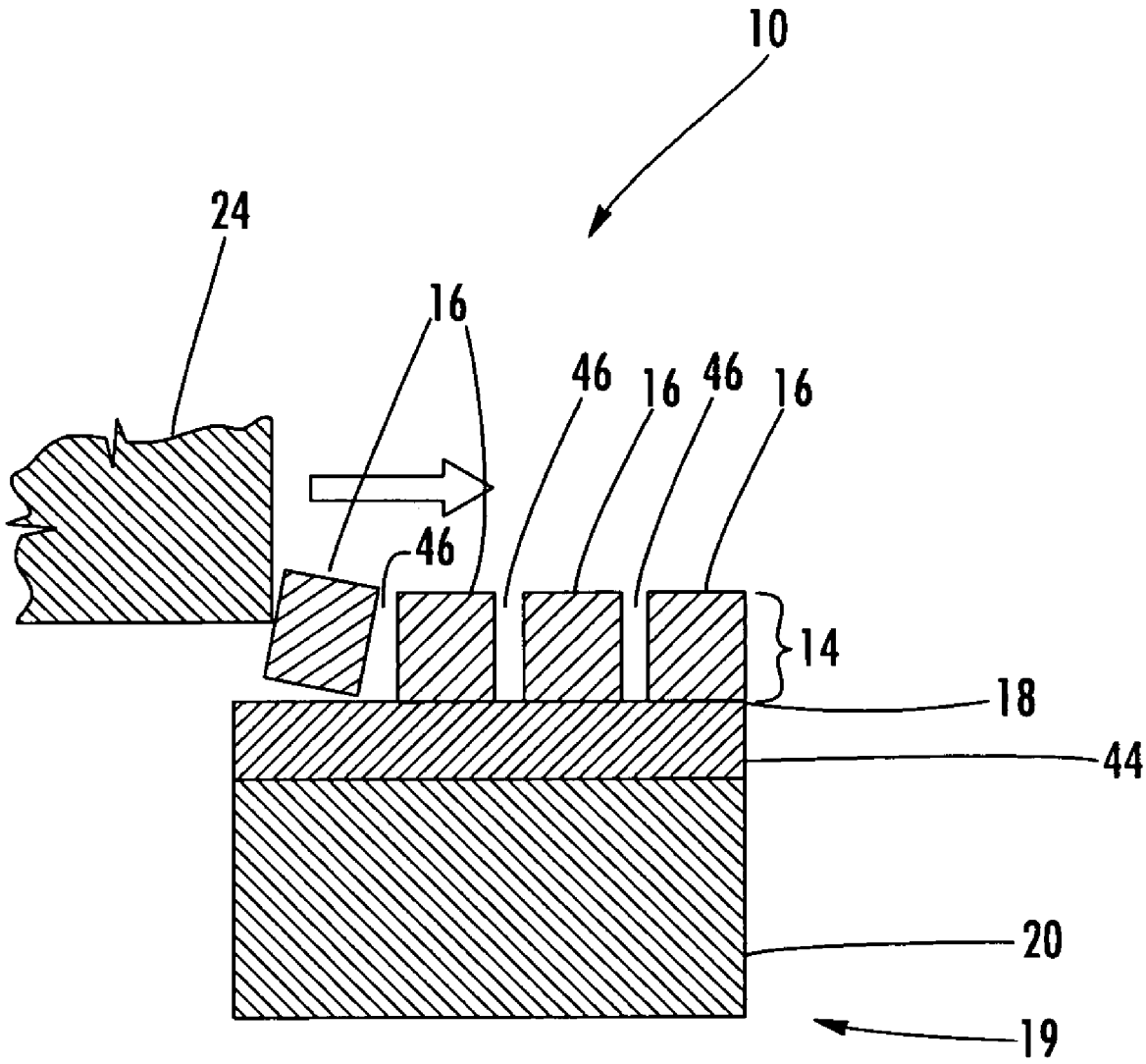
FIG. 6 is a cross-sectional view of a tip of a turbine blade contacting and shearing the abradable coating at a base of a column of abradable material forming the abradable coating.

As shown in FIG. 2, the abradable coating system 10 may be used together with a turbine engine 12. For instance, the turbine engine 12 may include a plurality of turbine blades 12 extending radially outward from a rotor assembly 26 and positioned into a plurality of rows forming stages. The turbine blades 12 may be formed from a material capable of withstanding the high temperature exhaust gases in the turbine engine 12. Stationary turbine vanes 28 may extend radially inward from an outer casing and be positioned in rows between adjacent turbine vanes 28. A plurality of ring seal segments 20 may be positioned radially outward from the tips 22 of the turbine blades 24. The ring seal segments 20 may be offset radially from the tips 22 of the turbine blades 24 forming a gap 32 such that the turbine blades 24 may rotate without contacting the ring seal segments 20.

Figure 9:
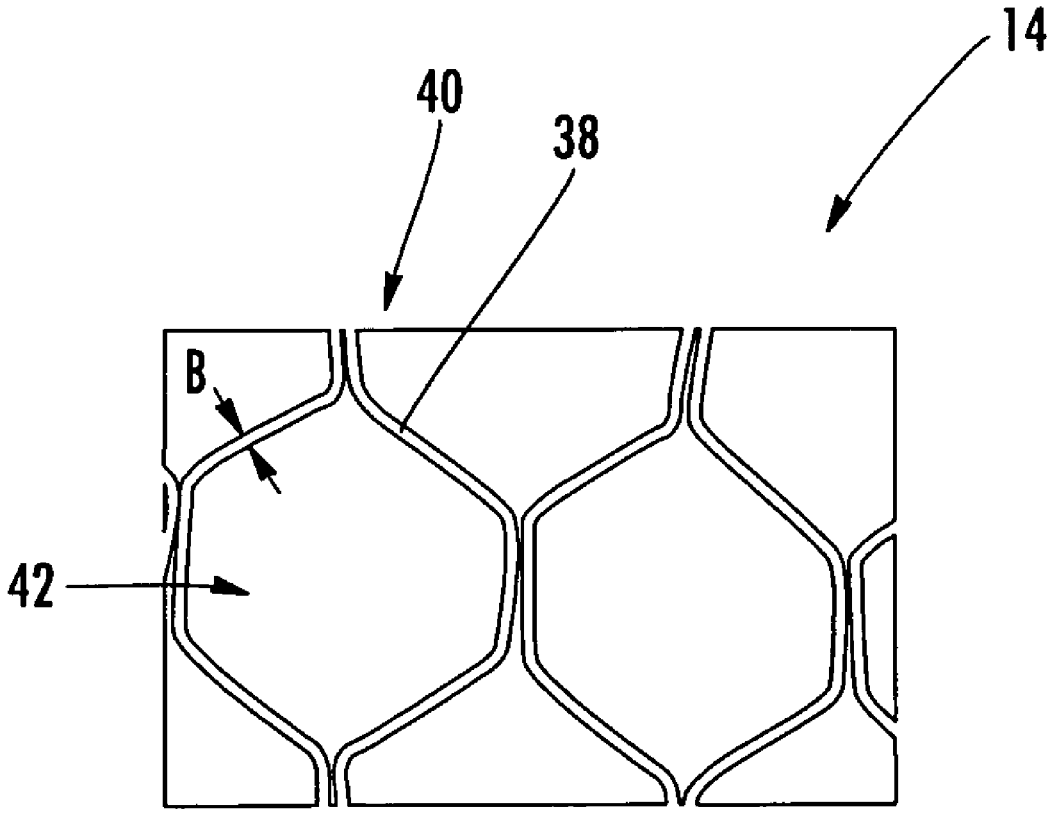
FIG. 9 is a perspective view of portion of a forming matrix of this invention.
Figure 10:
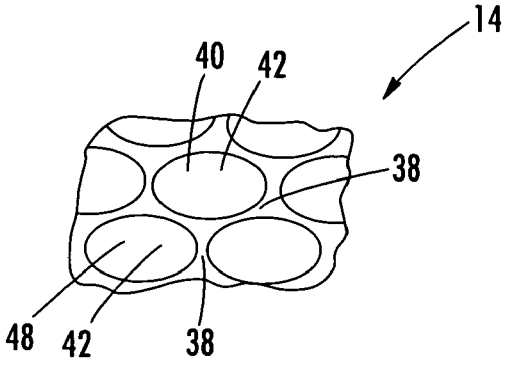
FIG. 10 is a perspective view of a portion of a forming matrix of this invention having an alternative configuration.
Figure 11:
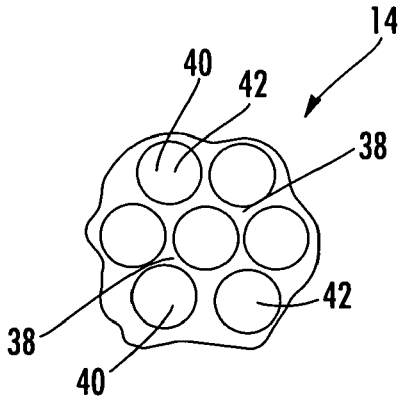
FIG. 11 is a perspective view of a portion of a forming matrix of this invention having an alternative configuration.
Figure 12:
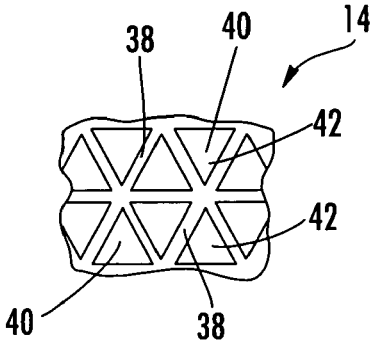
FIG. 12 is a perspective view of a portion of a forming matrix of this invention having an alternative configuration.
Figure 13:
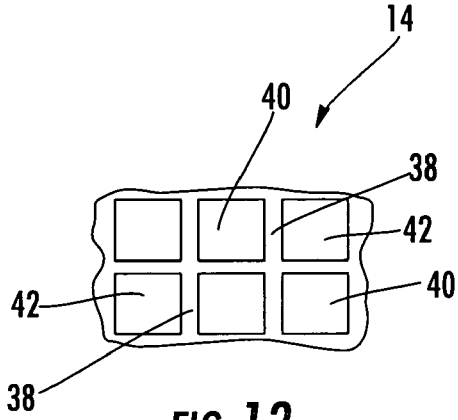
FIG. 13 is a perspective view of a portion of a forming matrix of this invention having an alternative configuration.
Figure 14:
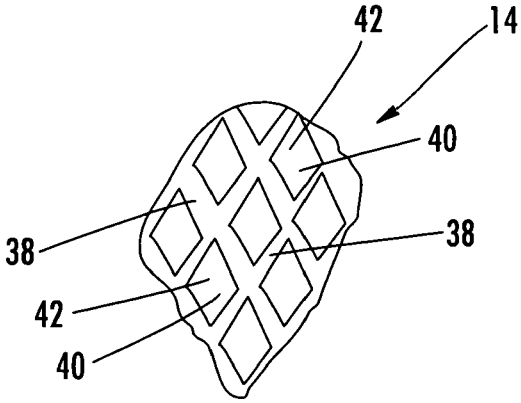
FIG. 14 is a perspective view of a portion of a forming matrix of this invention having an alternative configuration.

The abradable coating system 10 may include an abradable coating 14 applied to an outer surface 17 of a turbine component 19, which may be, but is not limited to, ring seal segments 20. The abradable coating 14 is configured to minimize the gap 32 while preventing excessive wear and damage to the turbine blade tip 22 that may occur while the turbine components are in different states of expansion, such as during a warm restart. The abradable coating system 14 may be formed from a forming matrix 36, as shown in FIGS. 9-14, covered with the abradable coating 14. The forming matrix 36 may be formed from a plurality of walls 38 that are coupled together to form a plurality of cells 40 having at least one opening 42 opposite to the ring seal segment 20. The opening 42 enables the abradable coating 14 to be applied into the cells 40 during the formation process. The cells 40 may have any appropriate configuration, such as, but not limited to, a hexagon, as shown in FIG. 9, an ellipse, as shown in FIG. 10, a circle, as shown in FIG. 11, a triangle, as shown in FIG. 12, a rectangle, as shown in FIG. 13, a diamond, as shown in FIG. 14, and other appropriate configurations. A single side wall 38 may be used to form a portion of one or more adjacent cells 40.

The forming matrix 36 may be made from any material having a melting point less than a steady state operating temperature of a turbine engine 12. In at least one embodiment, a steady state operating temperature of the turbine engine 12 may be about 2,500 degrees Fahrenheit. In at least one embodiment, the forming matrix 36 may be formed from materials such as, but not limited to, a material having a melting point less than a steady state operating temperature of a turbine engine or a fugitive material such as plastics, molybdenum, and other appropriate materials. A fugitive material is a material that occupies a physical area and burns off when exposed to temperatures above a threshold temperature, leaving a void absent of the fugitive material where the material once existed. In the abradable coating system 10, it is preferred that the material forming the forming matrix 36 have a melting point less than the steady state operating temperature of the turbine engine 12, which may be about 2,500 degrees Fahrenheit.

The forming matrix 36 may have any appropriate height. In at least one embodiment, the height of the cells 40 forming the forming matrix 36 as indicated by distance A in FIGS. 4 and 8 may be between about 0.005 and about 0.060 inches, and may be between about 0.020 and about 0.040 inches. The height of the cells 40 may vary depending on the gap 32 desired in a particular turbine engine 12. In at least one embodiment, a width of the cells, as indicated by distance B in FIG. 9 may be between about 0.125 millimeters and about 1.5 millimeters.

Figure 7:
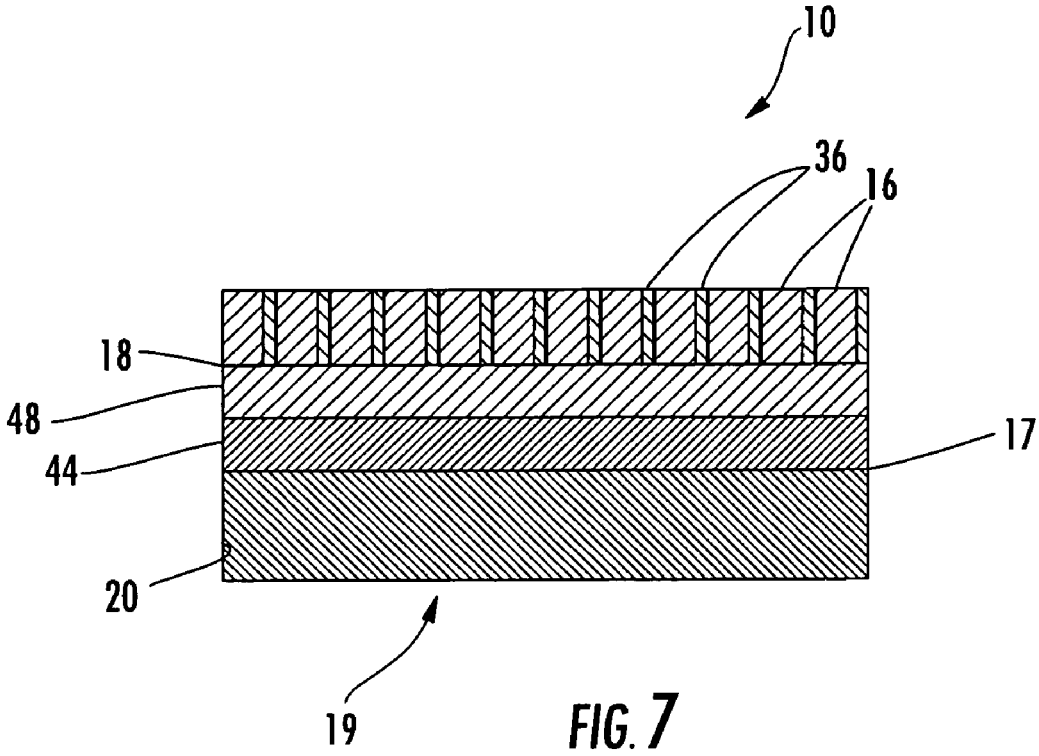
FIG. 7 is a cross-sectional view of an alternative embodiment of the abradable coating system of this invention with the forming matrix intact.
Figure 8:
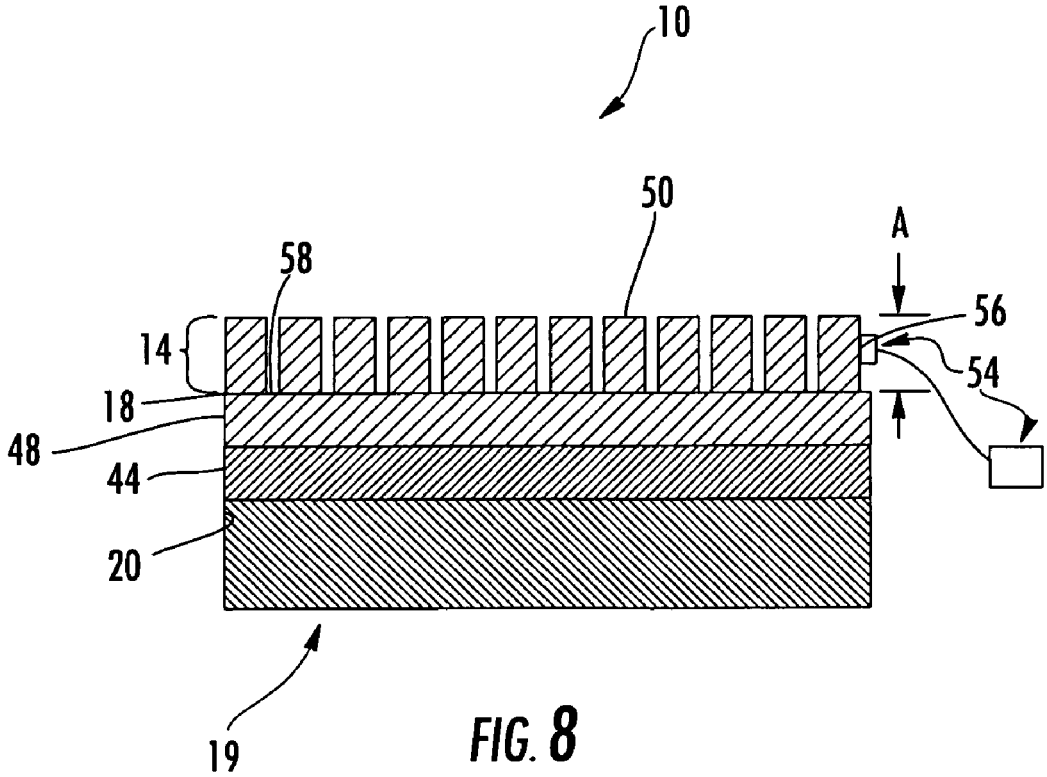
FIG. 8 is a cross-sectional view of the alternative embodiment of the abradable coating system shown in FIG. 7 after the forming matrix has been burned off due to exposure to turbine engine steady state operating temperatures.

The abradable coating system 10 may be formed by positioning the forming matrix 36 onto a ring seal segment 20. The forming matrix 36 may be attached directly to an outer surface 17 of the ring seal segment 20 or to one or more bond coatings 44 positioned between the outer surface 17 of the ring seal segment 20 and the forming matrix 36. The bond coatings 44 may be formed from materials such as, but not limited to, powders such as CoCrAlY, NiCrAlY, CoNiCrAlY, and rhenium containing versions and other appropriate materials. In another embodiment, as shown in FIG. 7, the abradable coating 14 may not be formed from columns 16 across the entire thickness. Rather, an abradable coating intermediate layer 48 may be applied to the ring seal segment 20 and then, the forming matrix 36 and abradable coating 14 may be applied to an outer surface of the abradable coating intermediate layer 48. The abradable coating intermediate layer 48 may provide additional thermal protection for the underlying turbine blade 24. In addition, since the inter-columnar channel 46 does not extend to the bond coating 44, overfracture may be limited to the intersection of the abradable coating intermediate layer 48 and the abradable coating 14 formed from the columns 16, as shown in FIG. 8. The abradable coating intermediate layer 48 may also be a thermal barrier coating (TBC), such as, but not limited to, 8YSZ, ceria stabilized zirconia, and other coating compositions not based on yttria, ceria, or zirconia.

During use, a turbine engine 12 is ramped up to a steady state operating temperature. At the steady state operating condition, the abradable coating system 10 is typically exposed to gases having temperatures of about 2,500 degrees Fahrenheit. Exposure of the forming matrix 36 to these gases causes the forming matrix 36 to burn or melt, thereby leaving the inter-columnar channels 46 and forming columns 16 of the abradable coating 14. The width of the inter-columnar channels 46 may be between about 0.5 mils and about 5.0 mils. After prolonged exposure to the exhaust gases, the tips 50 of the columns 16 of the abradable coating 14 may become sintered; however, the bases 18 of the columns 16 do not sinter. Thus, should a tip 22 of a turbine blade 24 contact the abradable coating 14, such as during a warm restart, the columns 16 of the abradable coating 14 may shear at the base 18, thereby protecting the tip 22 of the turbine blade 24 from damage. The columns 16 may also provide the abradable coating 14 with an increased resistance to spallation due to the inter-columnar channels 46 that enable the columns 16 to expand. In addition, the inter-columnar channels 46 may relieve stress on the abradable coating 14 that is imparted onto the abradable coating 14 from thermal expansion of the turbine blade 24.

The cells 40 of the forming matrix 36 may be configured to minimize the amount of force exerted on the blade tip 22 when contacting the abradable coating 14 during operation of the turbine engine 12, yet create as small a gap 32 as possible within safety parameters between the blade tips 22 and the abradable coating 14 on the ring seal segment 20. In particular, the abradable coating 14 may be formed with columns 16 having relatively small cross-sectional areas, such as less than about two $mm^2$ and, in one embodiment between about two $mm^2$ and about one $mm^2$, thereby resulting in a relatively high number of columns 16 per unit area. The cross-sectional area may be generally aligned with the outer surface 17 of the turbine component 19. This configuration may create a more efficient seal between the tips 22 of the turbine blades 24 and the abradable coating 14 on the ring seal segments 20 because the amount of unnecessary columns broken off at the outer edges of the seal will be reduced. In addition, as the cross-sectional area of the columns 16 decreases, the amount of force exerted on the blade tips 22 during the abrasion of the blade tips 22 with the abradable coating 14 decreases.

In another embodiment, the abradable coating system 10 may include an alarm system 54, as shown in FIG. 8, for indicating when a turbine blade tip 22 contacts the abradable coating 14. In at least one embodiment, the alarm system 54 may be formed from a metallic layer 56, such as, but not limited to, a thin metal foil. The alarm system 54 may be configured such that when a tip 22 of a turbine blade 24 contacts and cuts the metallic foil, a circuit is broken and an alarm is actuated. The metallic layer 56 may be deposited in a calibrated manner such that the alarm is triggered when the columnar abradable coating layer is worn to a specified depth by placing the metal layer 56 between the tip 50 and the base 18 of the column 16.

In another embodiment, as shown in FIG. 8, the abradable coating system 10 may include a temperature sensor 58. For instance, the temperature sensor 58 may be formed from two or more metals used to generate an EMF to determine temperature.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An abradable coating system for turbine airfoils, comprising:

an outer surface of a turbine component;

a forming matrix supported on the outer surface of the turbine component, wherein the forming matrix is formed from a plurality of walls that are coupled together to form a plurality of cells having at least one opening opposite the outer surface; and a first abradable coating deposited in the plurality of cells, wherein the forming matrix is formed from a material that melts during operation of a turbine engine in which the coating system is positioned thereby leaving the first abradable coating attached to the turbine component and forming a plurality of columns separated by voids.

2. The abradable coating system of claim 1, further comprising a second coating deposited between said outer surface of a turbine component and said first abradable coating such that said forming matrix is attached to an outer surface of the second coating.

3. The abradable coating system of claim 2, wherein said second coating is selected from the group consisting of a thermal barrier coating and a bond coating.

4. The abradable coating system of claim 3, further comprising a bond coating deposited on said outer surface and wherein said second coating is a thermal barrier coating and is deposited on said bond coating.

5. The abradable coating system of claim 1, wherein said turbine component is a ring seal segment positioned radially outward from the tips of rotatable turbine blades.

6. The abradable coating system of claim 1, wherein said material forming the forming matrix is a fugitive material selected from the group consisting of plastics and molybdenum.

7. The abradable coating system of claim 1, wherein said forming matrix is formed from walls having a thickness of less than about 0.5 mils and 5 mils.

8. The abradable coating system of claim 1, wherein each of the cells of the plurality of cells has a cross-sectional area in a plane generally aligned with the outer surface of the turbine component that is less than about 2 $mm^2$.

9. The abradable coating system of claim 1, wherein said first abradable coating is selected from the group consisting of 8YSZ and ceria stabilized zirconia.

10. The abradable coating system of claim 1, wherein at least one cell of the plurality of cells forming the forming matrix has a cross-sectional shape that is selected from the group consisting of a circle, an ellipse, a triangle, a rectangle, a hexagon, and a diamond.

11. The abradable coating system of claim 1, further comprising an alarm system for identifying whether a turbine blade tip has contacted the first abradable coating.

12. The abradable coating system of claim 11, wherein the alarm system comprises a metalized layer positioned between an outer surface of the turbine component and a tip of the columns of the abradable coating, wherein the metalized layer is coupled to an alarm system that is usable for actuating an alarm when a tip of a turbine blade contacts the metalized layer indicating the tip has worn through a predetermined distance of the abradable coating.

13. The abradable coating system of claim 1, further comprising a temperature sensor on the first abradable coating.

14. The abradable coating system of claim 13, wherein the temperature sensor is formed from at least two metals.

15. An abradable coating system for turbine airfoils, comprising:

an outer surface of a ring seal segment;

a forming matrix supported on the outer surface of the ring seal segment, wherein the forming matrix is formed from a plurality of walls that are coupled together to form a plurality of cells having at least one opening opposite the outer surface; and a first abradable coating deposited in the plurality of cells, wherein the forming matrix is formed from a material that melts during operation of a turbine engine in which the coating system is positioned thereby leaving the first abradable coating attached to the turbine component and forming a plurality of columns separated by voids.

16. The abradable coating system of claim 15, further comprising a bond coating deposited between said first abradable coating and said outer surface of a turbine component such that said forming matrix is attached to an outer surface of the second coating.

17. The abradable coating system of claim 15, wherein at least one cell of the plurality of cells forming the forming matrix has a cross-sectional shape that is selected from the group consisting of a circle, an ellipse, a triangle, a rectangle, a hexagon, and a diamond.

18. The abradable coating system of claim 15, further comprising an alarm system comprising a metalized layer positioned between an outer surface of the turbine component and a tip of the columns of the abradable coating wherein the metalized layer is coupled to an alarm system that is usable for actuating an alarm when a tip of a turbine blade contacts the metalized layer indicating the tip has worn through a predetermined distance of the abradable coating.

19. The abradable coating system of claim 15, further comprising a temperature sensor on the first abradable coating.

* * * * *